United States Patent [19]

Berrey

[11] 3,991,869

[45] Nov. 16, 1976

[54] PRINT HEAD IMPROVEMENT

[75] Inventor: Harry R. Berrey, Waynesboro, Va.

[73] Assignee: General Electric Company, Waynesboro, Va.

[22] Filed: Dec. 15, 1975

[21] Appl. No.: 640,720

[52] U.S. Cl. ..... 197/1 R; 335/276

[51] Int. Cl.[2] ..... B41J 3/04

[58] Field of Search ..... 197/1 R; 101/93.04, 101/93.05, 93.28, 93.29, 93.31, 93.32–93.34; 335/249, 250, 270–277

[56] References Cited

UNITED STATES PATENTS

| | | | |
|---|---|---|---|
| 2,524,127 | 10/1950 | Johnson | 197/1 R X |
| 3,266,418 | 8/1966 | Russo | 101/93.29 |
| 3,829,908 | 8/1974 | Schneider | 197/1 R |
| 3,842,955 | 10/1974 | Iwasaki | 197/1 R |
| 3,889,793 | 6/1975 | Cattaneo | 197/1 R |

FOREIGN PATENTS OR APPLICATIONS

| | | | |
|---|---|---|---|
| 1,577,409 | 8/1969 | France | 197/1 R |

*Primary Examiner*—Ralph T. Rader
*Attorney, Agent, or Firm*—Michael Masnik

[57] ABSTRACT

In a dot matrix printing head having a plurality of printing elements or styli each driven by an associated electromagnetically operated hinged armature, an adjustable spring arrangement for adjusting the preload biasing of each armature against an armature stop to insure that the associated electromagnets are matched with respect to flight time and can be set to deliver the proper printing force to each styli.

3 Claims, 4 Drawing Figures

PRINT HEAD IMPROVEMENT

BACKGROUND OF THE INVENTION

The present invention relates to dot matrix printing apparatus and more particularly to an arrangement for reducing the stresses and hence resultant breakage of printing styli employed in such apparatus.

In the so-called dot matrix printer, visual characters are formed by groups of dots imprinted on paper. Each dot is produced by driving an impact end of an elongated printing element against the platen for the paper and an ink ribbon disposed between the printing element and the platen. Commonly a plurality of printing elements are arranged in parallel to form a line transverse to the direction of travel of the paper. As the paper and printing elements are driven relative to one another, the dots are produced in successive parallel rows, one row at a time, by selectively actuating drivers which cause the printing elements to extend and retract according to the characters to be printed. Typical of this class of printers is the apparatus disclosed in French Pat. No. 2,094,311 entitled "Improvements in Printing Heads for Printing Machines", allowed Jan. 10, 1972 in the name of LogAbax SA, U.S. Pat. No. 3,829,908 entitled "Mosaic Print Head" issued in the name of Winfred Schneider, U.S. Pat. No. 3,842,955 entitled "Dot Printer" issued in the name of Kyubachiro Iwasaki dated Oct. 22, 1974.

In a dot matrix printer provision must be made for selectively actuating the printing element to imprint the dots on the paper. The actuating mechanisms are of necessity located in the vicinity of their respective elements. Thus, space occupied by the actuating mechanisms places a limit on the distance between the parallel printing elements in a line and accordingly the size of the characters. Various schemes have been resorted to for providing space for the element actuators while achieving suitable driving forces. Because of limited manufacturing tolerances, particularly in large scale production, difficulties occur in achieving proper printer operation uniformly among individually produced print heads. Efforts to control tolerances have lead to costly and unreliable print heads. In particular, it is desirable to control the printing forces developed by each of the printing elements. It is impractical particularly where large scale production is involved to customize each print head so that the desirable operating characteristics are achieved. It is desirable, as in the present instance, to maintain production tolerances within a practical level that results in both reliable and relatively inexpensive units while providing for some degree of individual adjustment. This is particularly true in the case of print heads employing driven printing elements. It is necessary to avoid the situation where the spring and other forces opposing the magnetic forces are so large that the magnet is unable to drive the spring into the record medium to affect printing or the forces are so relatively weak that the electromagnet drives the printing elements into the record medium with such force as to destroy the needle or injure the record medium.

Accordingly, it is one object of this invention to provide an improved print head for dot matrix printing.

It is another object of this invention to provide an individual adjustment for each print head to balance the forces on the printing element during the extending and retracting position to achieve optimum printing operation.

Another object of this invention is to provide an improved leaf spring arrangement for controlling the biasing force on the armatures used in driving the printing elements, particularly during their retracted position.

It is another object of this invention to control the degree of biasing of the armature with respect to a stop position by adjustably deflecting biasing leaf spring from a predetermined direction.

It is another object of this invention to provide improved means for adjusting a solenoid spring preload of each of the several printing elements or styli in a matrix printer.

The matters discussed above as well as further objects and features of the present invention will be more clearly understood and appreciated following a consideration of the accompanying drawings.

DETAILED DESCRIPTION OF THE INVENTION

Figure 1:
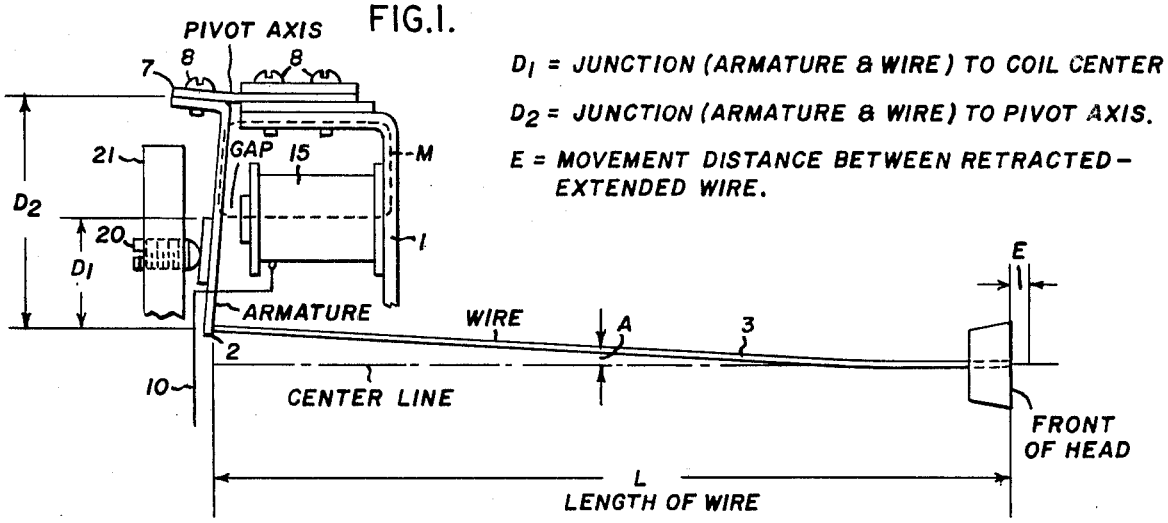
FIG. 1 is a sketch showing the manner in which a restoring force is developed for each of the printing elements by a hinged arrangement involving a biasing spring.

Referring to FIG. 1 of the drawings there is shown in simplified form the elements of a print head arrangement. In particular what is shown is a mechanism for driving a single printing wire in a multiwire matrix print head arrangement. Generally speaking, the arrangement of FIG. 1 is duplicated for each printing element by providing electromagnetic driving circuits or actuators comprising 1, 2, 7, 8 and 15 around the periphery of a frame with the printing elements 3 passing through the annular opening formed by the frame. In one embodiment in order to limit the amount of driving power required, it was desirable to provide the printing wires as near perpendicular to the record medium as possible consistent with the size of the armature needed at its junction with the printing elements. Each of the print wires as shown in FIG. 1 was arranged to depart from its straight line perpendicular position as little as possible. The print head shown comprises an actuator frame 1 on which there are supported a plurality of electromagnetically operated hinged armatures 2 for driving respective printing elements or wires 3. The wires are normally maintained in a nonprint position or retracted position and when electively extended drive the printing elements into contact with a record medium such as paper (not shown) which is positioned in front of the printing element. In one embodiment the print head comprises seven print wires or printing elements 3 each of which is connected at its driven end by connection to the end of respective movable armature 2 associated with electromagnet 15. Normally the armature 2 is maintained against the backstop by operation of a spring hinge 7 which connects the armature to the frame 1 by means of screws or rivets 8. The backstop 20 may be a threaded part for adjustability, supported on an annular ring 21 which is attached to and spaced from frame 1 by through bolts not shown. In this position the associated printing element is maintained in its retracted position. In a particular application, a printer responds to operation of a key in a keyboard to produce a plurality of control signals from a source for selectively driving individual ones of the printing elements 3 to produce a graphical display of a desired symbol on a record medium. Duration of the signals applied to the electromagnet are a fraction of a millisecond such that following impact the field established by electromagnet 15 collapses and the biasing spring 7 operates to quickly draw the associated printing element into its retracted position.

Normally, the armature 2 is in its upward or retracted position because of the biasing force established by hinge spring 7 which couples the armature to the frame 1. Upon a control signal being applied to the electromagnet, the magnet causes a magnetic field M to be established as shown in dotted line form. This magnetic field passes from the coil of the electromagnet 15 through the frame 1 through the air gap between the upper end of frame 1, and a portion of the armature adjacent the pivot axis through the armature, through the air gap between armature 2 and finally the core of the electromagnet 15. The establishment of this field causes the armature to be attracted downward driving the associated print wire 3 into its extended position to cause printing by impact. The signal energizing the electromagnet is of short duration such that the magnetic field is quickly removed enabling a spring 7 to restore the armature 2 and also the associated print wire to its retracted position. To achieve a low cost configuration that can easily be manufactured, it is desirable to provide as many components as possible with essentially identical configuration. This can be achieved if all of the forces involved in each of these configuration are kept the same, that is the restoring or configurations force established by spring 7 as well as the magnetic forces established by the electromagnets. This implies that the distance from the coupling junction of each print wire with its associated armature to the core of the associated electromagnetic actuator coil, that is D1 as shown in FIG. 1, is constant for each of the print elements. Also, this implies that the distance from each of the junctions of the print wires with its armature to the hinge or pivot axis is maintained constant. This is shown as D2 in FIG. 1. In a particular embodiment these dimensioning and structural arrangements of components produced a print head which was capable of operating at speeds in excess of 60 characters per second with a print wire movement being retracted in an extended position of fifteen thousandths of an inch and a wire displacement angle A of the order of three degrees. With this arrangement sufficient space was available for the electromagnets or coils 15 to be wound on a circular form therefore giving maximum reliability at minimum cost. Also because of the uniformity of dimensioning of components associated with each print wire, the number of parts required in manufacturing the print head are substantially reduced and few different adjustments are required during assembly.

Figure 2:
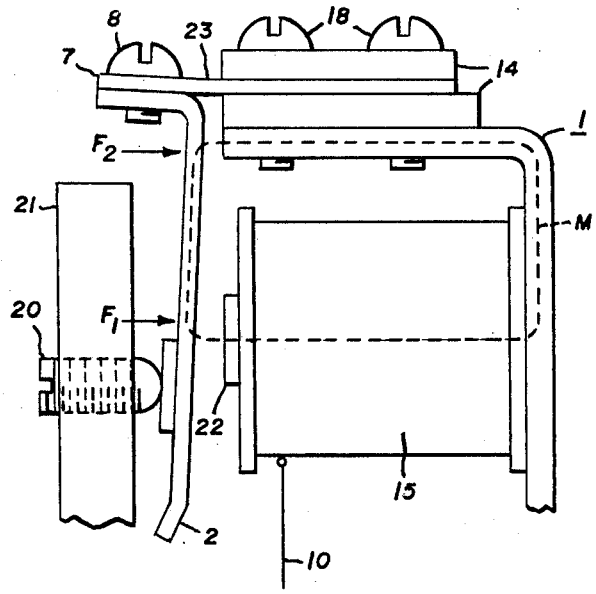
FIG. 2 illustrates a prior art arrangement of the junction formed between each of the printing elements and its associated hinged armature end.

Reference is now made to FIG. 2 for a more detailed explanation of the operation of the hinge arrangement utilized in the present invention. Wherever possible the same reference numerals have been retained. Essentially therefore, when energized by a signal applied to lead 10, the electromagnet 15 produces a magnetic field M which passes from its core 22 through the annular actuator frame 1 through an air gap before entering the upper end of armature 2 traveling through the armature and then back down into the core of the electromagnet 15. This resultant field produces two forces F1 and F2 as shown. The F1 force is developed in the region where the flux crosses from the armature to the rear and causes the armature and hence the print wire to deflect rightward movement about the pivot axis located at 23. The armature is generally made of high permeability iron and stiff enough such that it causes flexing of the spring 7 along its length extending from its connection to the actuator frame 1. The spring is attached to actuator frame 1 by spacers 14 of magnetic material and rivets or screws 18. The flexing end of the spring is located at such a position with respect to where the force F2 is developed such that the force F2 essentially establishes a compression stress in the spring 7. The force F2 is an unneeded force but is developed because an appreciable air gap effect occurs near the print axis where because of a spring characteristic the reluctance is relatively high. Force F2 essentially contributes no effect on flexing of the spring 7. Thus the spring action by 7 essentially is affected only by the force F1. As previously mentioned in a mass production operation, equipment and cost requirements limit the tolerances to which parts can be manufactured. In one situation the arrangement of FIG. 2 required considerable individual adjustment of manufactured print heads. In some instances this involved costly and time consuming bending and shaping of the components. Investigation revealed that under certain manufacturing practices, the preload on the armature in its retracted position was so great that the electromagnet was unable to drive the armature and hence the associated printing element into proper impact printing on a record medium. In other instances preload was so light that the electromagnet caused the spring wire to impact the paper with such force that it resulted in improper printing and even damage to the printing element. To provide simple low cost and ready adjustment of the preload condition, the spring 7 was provided with an adjustable feature.

Figure 3:
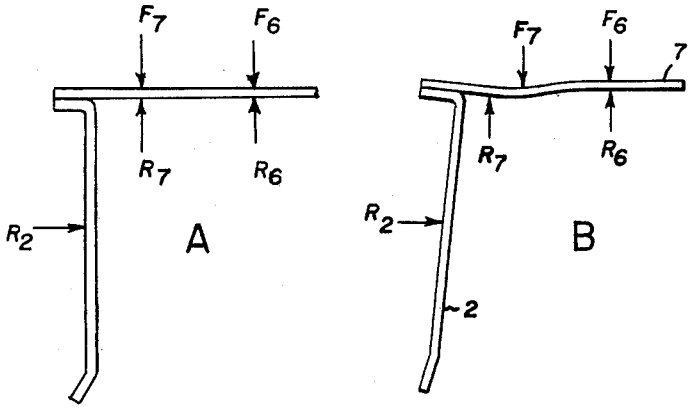
FIG. 3 describes forces involved in an improved biasing arrangement constituting the present invention.

Referring to FIG. 3 there is shown in simplified form the spring 7 coupled to an associated armature 2. Spring 7 was restrained at its end remote from coupling to the armature 2 by being rigidly clamped to the frame 1. This is shown symbolically by the force F6 being offset by the reaction force R6. In a particular embodiment this force and reaction force was developed over an area because of the use of area spacers 14. In order to vary the degree of biasing of the armature 2 with respect to its backstop 20, or the preload of the armature against the backstop, to compensate for manufacturing and material variations, means are provided for adjustably deflecting the leaf spring from the position it would normally assume with only the force F6 being developed. In particular, a bending moment was developed by applying the force F7 substantially as shown and offsetting this force with a reaction force R7 displaced from the point of application of force F7. This bending moment caused the spring to assume a different angular position. By making the force F7 adjustable, it is seen that the biasing force on the armature 2 against its backstop can be readily and simply controlled. By controlling the force F7, the reaction force developed at the backstop R2 can be controlled. In a typical application in order to make optimum use of the present invention, the armature 2 is coupled to the spring 7 at an angle such that the biasing force needs to be increased in order to meet the desired preload on the armature. This therefore permits the adjustment of F7 to be controlling as to the amount of biasing force actually employed in order to achieve proper printing operation.

Figure 4:
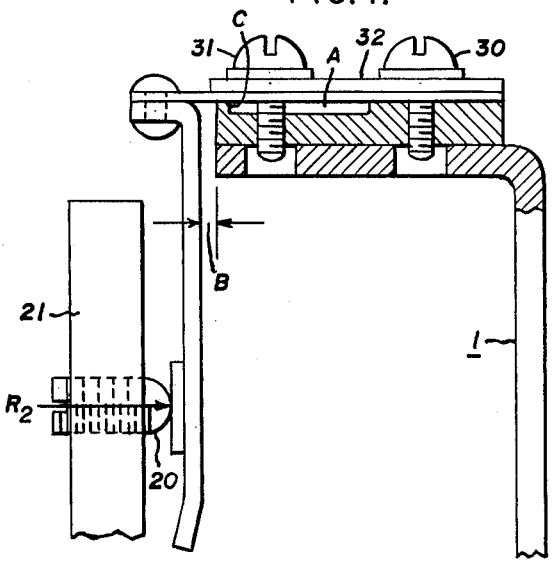
FIG. 4 illustrates one embodiment for establishing the desirable force patterns shown in FIG. 3.

Referring to FIG. 4 there is shown one embodiment for providing the control features possible with the force arrangement shown in FIG. 3. FIG. 4 illustrates that the print head frame has been modified to include a notch A. Screw 30 is the clamping screw which produces the force F6 of FIG. 3 and screw 31 is the adjusting screw which provides the adjustable force F7. Screw 30 which produces force F6 is the primary force which holds the unit together and maintains the proper air gap B. In order to insure that the forces F7 and R7 are not colinear which is necessary in order to create a bending moment on the spring, the screw 31 is positioned within the gap and away from its extremities. The resulting bending moment is developed about point C in the frame and serves to establish the spring preload R2 against the armature stop 20 by deflecting the spring into the notch A. By varying the force developed by screw 31, i.e. by adjusting the screw in or out, deflection of spring 7 varies from its initial position and thus provides the desired control over the preload R2. Point C on the frame acts as a fulcrum for the spring to pivot around. Spring plate 32 is captured by the screws 30 and 31 and lays on a spring 7 and deflects with it. Spring plate 32 serves to distribute the screw forces over a large area of the spring which would prevent cave in of the spring adjacent to the screw 31. The spring plate also insures that in event of overadjustment of the screw 31, the spring can be adjusted backwards and recover its initial position if desired. Finally, the force required to deflect a spring plate causes F7 and R7 to be high which secondarily helps to hold the unit together and to maintain a stable calibration.

It will be appreciated that modifications may be made in both the structure disclosed in order to produce a controllable biasing force on the armatures driving the print wires. The embodiment disclosed and discussed here and above may be modified by those skilled in the art. It is contemplated in the appended claims to include all such modifications which come within the spirit and scope of the teachings herein.

What I claim as new and desire to secure by Letters Patent of the United States is:

1. A printing head for a dot matrix printer to print characters on a record medium comprising at least one printing wire, means for driving said wire against a platen for printing a character comprising an annular frame having an opening, wire driving means comprising an electromagnet associated with a respective elongated armature for driving one end of such armature about a pivot axis located at the other end thereof, means for coupling said one end of said armature to one end of said wire at a junction, means for causing the wire to be driven along its longitudinal axis to an extended position against the record medium comprising means for mounting said electromagnet on said frame such that the junction is aligned with the annular opening of said frame, and with the longitudinal locus of said wire passing through said annular opening toward said platen, means for retracting said wire to a retracted position after being driven toward said record medium comprising means located along the outer periphery of said annular frame for resiliently biasing said armature in a given direction about said pivot axis so as to support said wire joined thereto in said retracted position, said retracting means comprising an elongated, flat, leaf spring rigidly attached at one end to said frame and extending from said frame in a direction substantially perpendicular to the length of the armature and joined to the other end of said armature, a backstop for said armature, a pivot point for said spring, means for varying the degree of biasing of said armature with respect to said backstop in the retracted position of said wire comprising means for producing a bending moment in said spring about said pivot point.

2. A matrix printing head comprising at least one elongated printing needle, means for moving said needle longitudinally comprising an electromagnet including a pole core, an armature having a first end movable toward and away from said pole core and an opposite second end, means pivotally supporting the opposite second end of said armature, means for coupling said first end of said armature to said needle, said armature adapted to respond to applied signals for displacing said needle in the longitudinal direction away from a stop position, an armature backstop, means for resiliently biasing said armature against said backstop, said biasing means comprising a flat leaf spring extending in a direction substantially perpendicular to the length of the armature and connected at one end thereof to said second end of said armature, means for attaching said leaf spring at its second end to said frame, means for preloading said armature with respect to said backstop, means to vary the degree of said preloading with respect to said stop position comprising means for applying a bending moment in said spring about a pivot point.

3. An arrangement according to claim 2 wherein said frame comprises a notch, means for rigidly attaching said spring to said frame on one side of said notch, and said means for applying said bending moment comprising means for causing said spring to be deflected into said notch.

* * * * *

UNITED STATES PATENT OFFICE

CERTIFICATE OF CORRECTION

Patent No. 3,991,869 Dated November 16, 1976

Inventor(s) Harry R. Berrey

It is certified that error appears in the above-identified patent and that said Letters Patent are hereby corrected as shown below:

Column 3, line 39, cancel "configurations" and insert

-- biasing --

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*